United States Patent [19]

Denis

[11] 3,967,459

[45] July 6, 1976

[54] INDEPENDENT WEIGHT SYSTEM

[75] Inventor: David R. Denis, Azusa, Calif.

[73] Assignee: Under Sea Industries, Inc., Compton, Calif.

[22] Filed: Jan. 23, 1975

[21] Appl. No.: 543,634

[52] U.S. Cl. ..... 61/70; 9/342; 128/142 R

[51] Int. Cl.[2] ..... B63C 11/02

[58] Field of Search ..... 61/70, 71; 9/342, 313; 128/142

[56] References Cited

UNITED STATES PATENTS

| | | | |
|---|---|---|---|
| 2,818,858 | 1/1958 | Holm | 9/313 X |
| 3,269,129 | 8/1966 | Zambrano | 61/70 |
| 3,436,777 | 4/1969 | Greenwood | 9/313 X |
| 3,820,348 | 6/1974 | Fast | 61/70 |
| 3,842,611 | 10/1974 | Anderson | 61/70 |

*Primary Examiner*—Jacob Shapiro
*Attorney, Agent, or Firm*—Lyon & Lyon

[57] ABSTRACT

An independent weight system for underwater breathing equipment, the underwater breathing equipment having an air tank and a flotation device attached to a supportive back pack assembly, the weight system having a clamping means securing a weight assembly to the tank whereby the center of gravity of the underwater breathing equipment and attached weight system is below the center of buoyancy of the underwater breathing equipment and weight assembly.

8 Claims, 3 Drawing Figures

INDEPENDENT WEIGHT SYSTEM

BACKGROUND OF THE INVENTION

1. Subject Matter of the Invention

This invention relates generally to underwater diving equipment, and more specifically to improved diving equipment wherein diving weights may be positioned in an optimum location.

2. Description of the Prior Art

In order to allow for swimming and diving for extended periods of time below water, divers may utilize portable tanks of compressed air. Such tanks are secured to the user-diver by means of a pack having harness or strap assemblies allowing for the pack and the tank attached to the pack to be positioned on the diver's back. The compressed air in the tank or tanks is conducted through suitable pressure regulation devices, hoses, valves and the like to the diver's mouth and respiratory system.

Typically, underwater diving equipment additionally includes a safety flotation or buoyancy device. As the cummulative effect of the underwater breathing equipment is buoyant and tends to float the diver on the water's surface, divers generally employ releasable weights in order to overcome this buoyancy force, thereby allowing the diver to submerge.

Such weights are typically attached to the diver himself by means of a weight belt, to the diving equipment pack, or both. However, such a weight system tends to upset the balance of diver, thus poducing an undesirable safety aspect and making the diver's movements more difficult. Weights employed on a belt are often not evenly distributed and may shift about the diver's waist so as to upset his balance. Weights attached to the diving pack produce a center of gravity positioned above the center of the net buoyancy force of the underwater diving equipment, thus when the equipment is utilized by a diver swimming horizontally, such a weight system tends to push the upper portion of the diver's body downwards. The seriousness of shifting or upsetting the balance of the diver is particularly important during emergency situations when it is desirable that the diver's position stabilize in a generally upright position and that he be positioned so as to be able to activate the weight release mechanism.

SUMMARY OF THE INVENTION

According to the present invention, an independent weight system for underwater breathing equipment, the underwater breathing equipment having an air tank and a flotation device attached to a supportive back pack assembly, is provided with a weight system having a clamping means securing a weight assembly to the tank whereby the center of gravity of the underwater breathing equipment and attached weight system is below the center of buoyancy of the underwater breathing equipment and weight assembly. As the weight system is independently attached to the tank, it may be positioned at or near the tank bottom. Such a weight system location provides for self-righting underwater breathing equipment, thus avoiding or substantially reducing a forward or backward movement tending to force the diver's face and upper body into the water upon surfacing.

DESCRIPTION OF PREFERRED EMBODIMENTS

Figure 1:
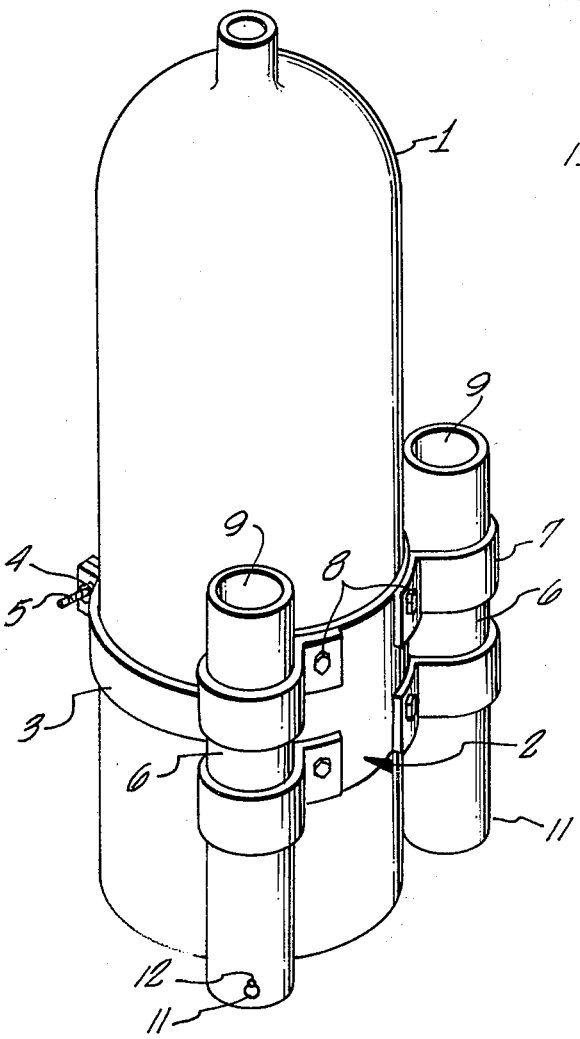
FIGS. 1 and 2 are perspective views of the independent weight system of this invention.

Referring now to FIG. 1, a compressed air tank 1 is shown, the tank 1 being modified by a weight assembly 2. The weight assembly 2 has an anchor clamp 3 which may be clamped directly to the external surface of the tank 1 by any of a number of typical securing devices such as a threaded bolt 5 and nut 4 which may be tightened so as to secure the anchor clamp 3 to the tank 1. A weight receptacle 6 is in turn secured to the anchor clamp 3 by means of one or more clamping bands 7. The clamping bands 7 may be secured to the anchor clamp 3 by any suitable fastening means such as welding or bolting means such as bolts 8. Alternately, the weight receptacle 6 may be directly clamped to the tank 1. The top of the weight receptacle 6 is provided with a cap 9 which seals the top of the weight receptacle 6. A plurality of weights or ballast material (not shown) are inserted through the open bottom 10 of the weight receptacle 7. When the weight receptacle 6 has been filled with a pre-determined amount of weight, a closure pin 11 is inserted in the weight receptacle 6, the closure pin 11 passing through and between opposite holes 12 in the base of the weight receptacle 6. When it is desired to release the weights, as may prove necessary in an emergency, the pin 11 may be removed from the weight receptacle holes 12, thereby allowing the weights to be released from the weight receptacle 6.

Figure 2:
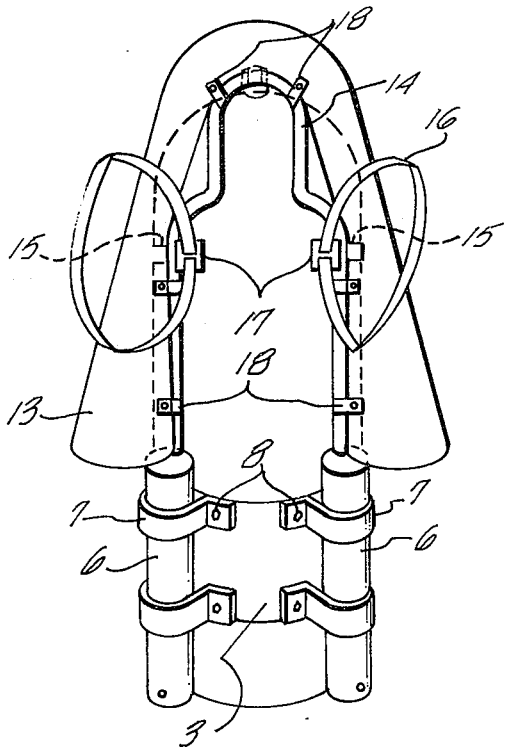

FIG. 2 illustrates the tank 1 and weight assembly 2 being further modified by a flotation device 13, a supportive backpack assembly 14 and a harness or strap assembly 16. The pack assembly 14 is connected to the tank 1 independent of the weight assembly 2 by means of a releasable connective strap 15. The harness assembly 16 and flotation device 13 are also attached to the pack assembly 14 by means of connective devices such as connective straps 17 and 18 respectively. Such a configuration allows for the pack assembly 14 with the connected flotation device 13 and harness assembly 16 to be connected to the tank 1 independently of the weight assembly 2.

Figure 3:
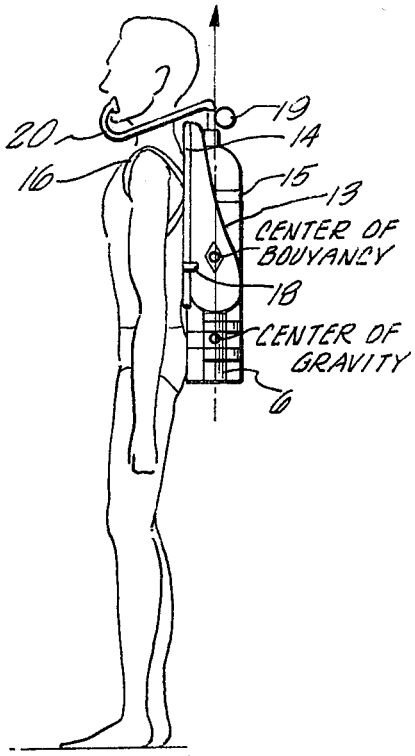
FIG. 3 is a side view of the independent weight system of this invention.

Referring now to FIG. 3, the weight assembly 2 is shown mounted to a tank 1, the tank 1 being releasably attached to a backpack assembly 14 to which are also attached the flotation device 13 and the harness assembly 16. The weight assembly 2 is positioned on the tank 1 such that the center of gravity of the tank 1, flotation device 13, pack assembly 14 and the attached weight system 2 is located below the net buoyancy force of the tank 1, flotation device 13, pack assembly 14, harness assembly 16, and weight assembly 2. The tank 1 shown in FIG. 3 is further provided with an air regulation valve 19 and an air conductive tube 20. In one embodiment the underwater breathing equipment does not include the flotation device 13, thus less weights are required in the weight receptacle 6.

If the diver is in other than a substantially verticle position, the fact that the weight assembly 2 is located near the lower portion of the tank 1 produces a moment which tends to "right" the diver and position his body in an upright position. The greater the distance between the center of buoyancy and the center of gravity the greater the "righting" moment lever arm and resultant moment. Thus it is desirable to be able to position the weight assembly 2 as low on the diving equipment as possible. Such a configuration allows for a diver to surface with his head extended substantially straight out of the water, rather than being required to overcome a forward or backward moment produced by a weight assembly of the type employed in the prior art. For a detailed discussion of buoyancy see *Elements of Fluid Mechanics*, Buoyancy, Dennis G. Shepherd, Harcourt, Brace & World, pp. 57–66 (1965) and *Principles of Fluid Mechanics*, Stability of Floating Bodies, Metacenter and Metacentric Height, Salamon Eskinazi, Allyn & Bacon pp. 60–64 (1962).

The present invention has been described in detail for purposes of illustration, and is not intended to be limited by this description or otherwise, except as defined in the appended claims.

I claim:

1. An independent weight system for underwater breathing equipment having a compressed air tank and a flotation device attached to a supportive backpack assembly, said weight system comprising:

a weight assembly having;

at least one weight receptacle;

a plurality of weights positioned within said weight receptacle;

restraining means located at the base of said weight receptacle, said restraining means being manually activatable to release said plurality of weights; and a clamping means securing said weight receptacle to said tank, said clamping means mounting said weight to said tank whereby the center of gravity of said underwater breathing equipment and attached weight assembly is below the center of buoyancy of said underwater breathing equipment and weight assembly.

2. The independent weight system claimed in claim 1 wherein said clamping means is further defined as having an anchor clamp positioned about the lower portion of said compressed air tank and at least one clamping band securing said weight receptacle to said anchor clamp.

3. The independent weight system claimed in claim 1 wherein said supportive backpack assembly is provided with a releasable body engaging harness, thereby allowing said backpack and said attached air tank and flotation device to be mounted on a diver's back.

4. The independent weight system claimed in claim 1 wherein said weight recepticales are further defined as a pair of longitudinally spaced verticle, cylindrical weight receptacles.

5. The independent weight system claimed in claim 4 wherein said weight receptacle restraining means comprises a manually removable pin extending between and through a pair of holes in opposite sides of the weight receptacle base.

6. The independent weight system claimed in claim 1 wherein said clamping means is positioned about the bottom of said compressed air tank.

7. The independent weight system claimed in claim 1 wherein said tank is releasably attached to said backpack assembly.

8. An independent weight system for underwater breathing equipment having a compressed air tank and a flotation device attached to a supportive backpack assembly, said weight system comprising:

a weight assembly having:

a pair of longitudinally spaced, verticle, cylindrical weight receptacles;

a plurality of weights positioned within said weight receptacles;

a manually removable pin extending between and through a pair of holes in opposite sides of the base of each of said weight receptacles; and a clamping means securing said weight receptacles to said tank;

said clamping means having:

an anchor clamp positioned about the bottom of said compressed air tank; and at least one clamping band securing said weight receptacles to said anchor clamp, said clamping means mounting said weight to said tank whereby the center of gravity of said underwater breathing equipment and attached weight assembly is below the center of buoyancy of said underwater breathing equipment and weight assembly.

* * * * *